US006760554B2

(12) United States Patent
Fina et al.

(10) Patent No.: US 6,760,554 B2
(45) Date of Patent: Jul. 6, 2004

(54) DROP SEAL ACTUATOR

(75) Inventors: Eugene J. Fina, Charlestown, MA (US); Andrij Harlan, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 34 days.

(21) Appl. No.: 10/212,964

(22) Filed: Aug. 5, 2002

(65) Prior Publication Data

US 2004/0022554 A1 Feb. 5, 2004

(51) Int. Cl.[7] ..... G03G 21/00

(52) U.S. Cl. ..... 399/102; 399/345; 399/351

(58) Field of Search ..... 399/102, 345, 399/350, 351

(56) References Cited

U.S. PATENT DOCUMENTS

| | | | | |
|---|---|---|---|---|
| 4,400,082 A | | 8/1983 | Kiba | |
| 4,516,850 A | * | 5/1985 | Nishikawa | 399/350 X |
| 4,640,608 A | | 2/1987 | Higaya et al. | |
| 4,910,560 A | | 3/1990 | Kanada | |
| 5,442,422 A | | 8/1995 | Owens, Jr. et al. | |
| 5,875,382 A | * | 2/1999 | Inoue | 399/345 |
| 5,966,565 A | | 10/1999 | Pozniakas et al. | 399/102 |
| 5,991,568 A | * | 11/1999 | Ziegelmuller et al. | 399/102 |

* cited by examiner

*Primary Examiner*—William J. Royer
(74) *Attorney, Agent, or Firm*—Andrew D. Ryan

(57) ABSTRACT

An apparatus for cleaning an imaging surface with a cleaning blade including a drop seal actuator that urges a seal into position and then collects toner in a cleaner unit. The seal captures falling accumulated toner from the cleaning blade which may contaminate the xerographic area when the cleaning blade is retracted from the imaging surface. Implementation of the drop seal actuator in contact with the seal positions the seal to contain toner within the cleaner unit.

24 Claims, 4 Drawing Sheets

DROP SEAL ACTUATOR

FIELD OF THE INVENTION

This invention relates generally to a cleaner apparatus, and more particularly to an improved cleaning blade and drop seal actuator and seal in a cleaning system.

BACKGROUND OF THE INVENTION

In the process of cleaning a photoreceptor or photoconductor, a cleaning blade is used to clean the imaging surface and toner is removed from the imaging surface which accumulates at the cleaning edge of the cleaning blade. As a result, toner contamination of the xerographic area occurs when the cleaning edge of the cleaning blade is retracted from the imaging surface. The toner that has accumulated at the cleaning edge falls down the imaging surface length during retraction. The toner contamination may result in copy quality defects and decreased operating efficiency of various xerographic components. In order to achieve engineering reliability, service and customer satisfaction goals improvements in cleaning blades and seals are desired to reduce such toner contamination problems.

The following disclosures may be relevant to various aspects of the present invention and may be briefly summarized as follows:

U.S. Pat. No. 5,966,565 relates to a cleaning seal with a soft cleaning seal tip that provides a seal between a cleaning housing and a photoconductive member in an electrophotographic machine. The cleaning seal is made of a relatively stiff material so that the cleaning seal can collect and support toner removed from the photoconductive member. In the absence of the soft cleaning seal tip, the relatively stiff material of the cleaning seal contacting the photoconductive member excessively scratches the photoconductive member. The soft cleaning seal tip solves this problem by providing a relatively soft surface on the photoconductive member, resulting in fewer scratches on the photoconductive member. The composite cleaning seal provides sufficient force to remove and support the toner removed from the photoconductive member while cushioning the force of the relatively stiff cleaning seal against the photoconductive member.

U.S. Pat. No. 5,442,422 relates to an apparatus for cleaning an imaging surface with a hybrid cleaner that includes the implementation of a contamination seal in a cleaner unit. The contamination seal captures falling accumulated toner from a blade edge and in a brush nip, due to gravitation, which contaminates the xerographic area when the cleaner blade and disturber brush are retracted from the imaging surface. The contamination seal rests along the length of a blade portion that extends from a blade holder. In this position, the contamination seal does not touch the imaging surface to cause scratches nor does it interfere with the blade's ability to clean the imaging surface. Implementation of the contamination seal contains toner emission within the cleaner from the blade edge and brush nip.

U.S. Pat. No. 4,910,560 relates to a cleaning device provided with a blade adapted to contact the peripheral surface of a photosensitive drum and wipe residual toner off of the photosensitive drum. A duct is disposed separately from the blade, and is adapted to remove the toner wiped off by the blade by air suction. In the interval between the blade and the duct, there is disposed a sealing member which serves to prevent ambient air from entering the duct through the interval. This sealing member is fixed either on a stationary region of a holder for the blade or on the basal end part of the blade integrated with the holder or on the outer surface of the duct, and contacts the duct if mounted on the holder or the blade, or contacts the blade or holder if mounted on the duct.

U.S. Pat. No. 4,640,608 relates to a cleaning method which includes a cleaning blade being brought into pressure contact with a photoconductor at least prior to the movement of the photoconductor, and moving the cleaning blade away from the surface of the photoconductor after the movement of the photoconductor is stopped with completion of a copying process. A stationary seal member allows uncleaned toner on the photoconductor to pass therethrough but does not permit the toner removed by the cleaning blade to pass therethrough.

U.S. Pat. No. 4,400,082 relates to a cleaning apparatus for removing toner remaining on a moving photoconductive member which has a resilient blade in bearing contact with a surface of the photoconductive member and reciprocatingly movable laterally of the direction of movement of the surface, a seal member provided at each end of the photoconductive member and having a width in the direction of the lateral movement of the blade equal to at least the range of lateral movement of the corresponding end of the blade, a seal member being disposed in contact with the rear seal member being disposed in contact with the rear surface of the blade in the range of lateral movement of the blade end. Toner particles are thereby prevented from falling from the blade off the end of the photoconductive member.

All documents cited herein, including the foregoing, are incorporated herein by reference in their entireties.

SUMMARY OF INVENTION

In embodiments, there is provided an electrostatographic apparatus including a first member having a length, a first end, and a second end. The first end is for removing particles from a photoreceptor surface. The first end is adapted to move from an operative position contacting the photoreceptor surface to an inoperative position spaced from the photoreceptor surface. The second end is adapted to pivot and includes a second member associated therewith. A third member is spaced from the first member and has a length and a free end. The second member is adapted to contact the third member as the first member is moved to an inoperative position causing the third member to move an angular distance.

In other embodiments, there is provided a customer replaceable unit including a cleaning blade assembly having a first end and a second end. The first end is for removing particles from a photoreceptor surface. The first end is adapted to move from an operative position contacting the photoreceptor surface to an inoperative position spaced from the photoreceptor surface. The second end has a protrusion thereon. A seal including a length and a free end is adapted to move from a first position to a second position as the first end of the cleaning blade assembly moves away from the photoreceptor surface and the protrusion contacts the seal at a position located a distance from the free end.

In further embodiments, there is provided an apparatus for cleaning particles from a surface including a cleaning blade for removing particles from the surface. The cleaning blade is adapted to move between an operative position contacting the surface to remove particles therefrom and an inoperative position spaced from the surface. The cleaning blade includes a free blade end movable between the operative position and the inoperative position, and a pivot end for rotating about a pivot. A seal is movable between a first position and a second position in response to a protrusion on a portion of the pivot end moving in contact with the seal to urge the seal in the direction of the surface. The seal comprises a flexible sheet chosen from the group of materials consisting of polyester thermoplastics, polycarbonate, polyurethane, polyethylene, and polypropylene.

In yet other embodiments, there is provided a cleaning station for cleaning toner from an endless photoconductive member in an apparatus including a cleaning housing. A cleaning blade assembly is supported by the cleaning housing. The cleaning blade assembly includes a first end and a second end. The first end is for removing particles from a photoconductive member. The first end is adapted to move from an operative position contacting the photoconductive member to an inoperative position spaced from the photoconductive member. The second end includes a protrusion thereon. A seal includes a length and a free end and is sufficiently stiff so that the seal can support the toner removed from the photoconductive member. The seal is located after the cleaning blade has removed the toner from the photoconductive member. The seal is movable from a first position to a second position as the first end of the cleaning blade assembly moves away from the photoconductive member such that the protrusion contacts the seal at a position located a distance from the free end.

In other embodiments, there is provided a method of preventing toner contamination including: accumulating toner from a photoconductive surface on a free end of a blade, the blade comprising a pivot end including a protrusion thereon; and rotating the free end of the blade away from a surface causing the protrusion on the pivot end to pivot and contact the seal urging the seal to move toward the surface.

Still other aspects of the invention will become readily apparent to those skilled in the art from the following detailed description, wherein embodiments are shown and described, simply by way of illustration. As will be realized, the invention is capable of other and different embodiments and methods of construction, and its several details are capable of modification and interchangeability in various obvious respects, all without departing from the invention. Accordingly, the drawings and description are to be regarded as illustrative in nature, and not as restrictive.

DETAILED DESCRIPTION OF THE INVENTION

While the principles and embodiments of the present invention will be described in connection with an electrostatographic reproduction apparatus, it should be understood that the present invention is not limited to that embodiment or to that application. Therefore, it should be understood that the principles of the present invention and embodiments extend to all alternatives, modifications, and equivalents thereof.

Figure 1:
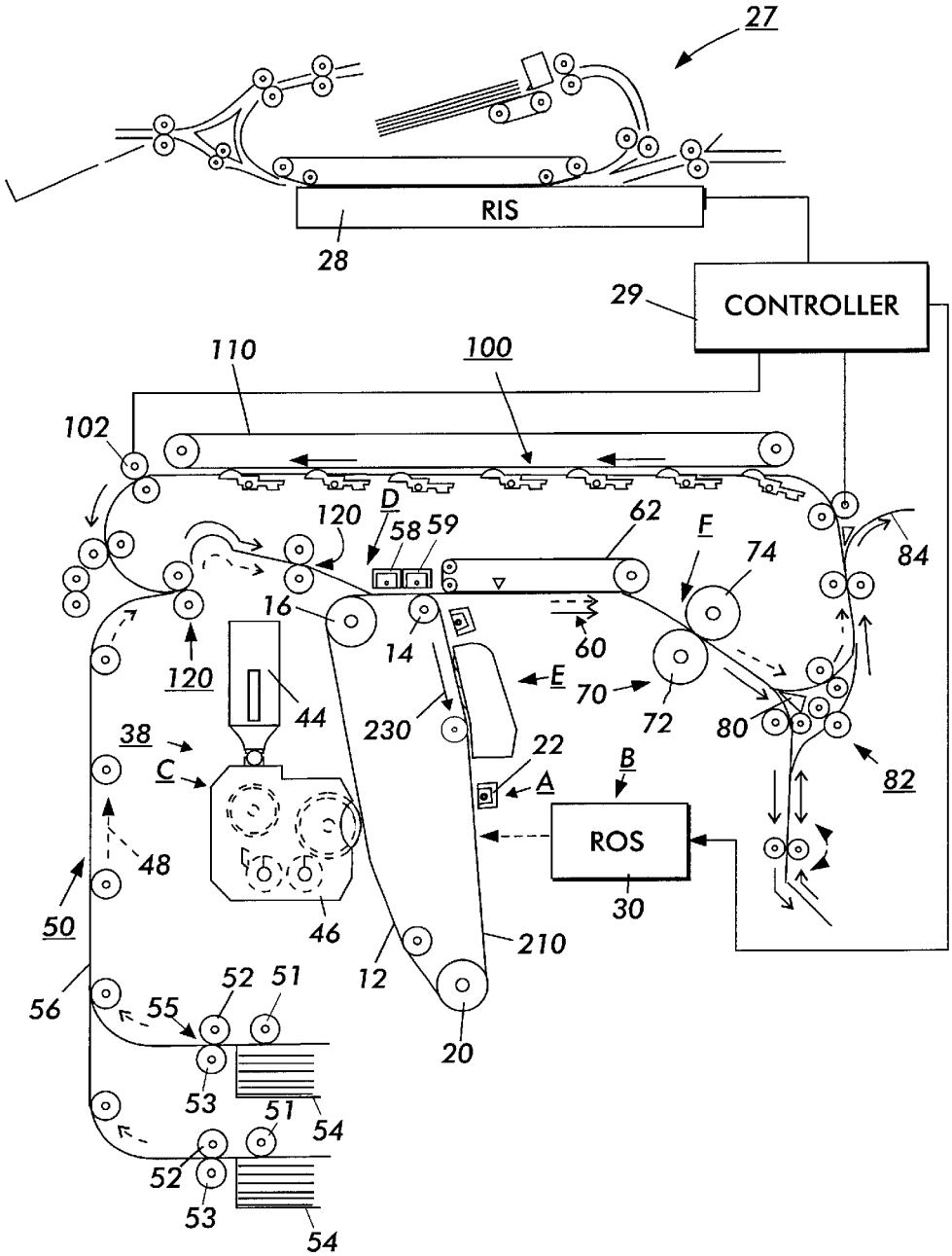
FIG. 1 is a schematic elevational view of an embodiment of an electrophotographic printing machine utilizing an embodiment of a drop seal actuator.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the component with a precision aperture of the present invention may be employed in a wide variety of devices and is not specifically limited in its application to the particular embodiment depicted herein.

Referring to FIG. 1 of the drawings, schematically illustrated is an electrophotographic printing or copying machine including a document positioned in a document handler 27 on a raster input scanner (RIS) 28. The RIS 28 contains document illumination lamps, optics, a mechanical scanning drive and a charge coupled device (CCD) array. The RIS 28 captures the entire original document and converts it to a series of raster scan lines. This information is transmitted to a controller or electronic subsystem (ESS) 29 which controls a raster output scanner (ROS) 30 described below.

The electrophotographic printing machine generally employs a photoconductive belt 210. The photoconductive belt 210 may be made from a photoconductive material coated on a ground layer, which, in turn, is coated on an anti-curl backing layer. Photoconductive Belt 210 moves in the direction of arrow 230 to advance successive portions sequentially through the various processing stations disposed about the path of movement thereof. Photoconductive Belt 210 is entrained about stripping roller 14, tensioning roller 16 and drive roller 20. As drive roller 20 rotates, it advances photoconductive belt 210 in the direction of arrow 230.

Initially, a portion of the photoreceptor surface or photoconductive surface 12 of the photoconductive belt 210 passes through charging station A. At charging station A, the corona generating device indicated generally by the reference numeral 22 charges the photoconductive belt 10 to a relatively high, substantially uniform potential.

At an exposure station, B, a controller or electronic subsystem (ESS) 29 receives the image signals representing a desired output image and processes these signals to convert them to a continuous tone or greyscale rendition of the image which is transmitted to a modulated output generator, for example the raster output scanner (ROS), 30. Preferably, ESS 29 is a self-contained, dedicated minicomputer. The image signals transmitted to ESS 29 may originate from a RIS 28 as described above or from a computer, thereby enabling the electrophotographic printing machine to serve as a remotely located printer for one or more computers.

Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS 30 will expose the photoconductive belt 210 record an electrostatic latent image thereon corresponding to the continuous tone image received from ESS 29. As an alternative, ROS 30 may employ a linear array of light emitting diodes (LEDs) arranged to illuminate the charged portion of photoconductive belt 210 on a raster-by-raster basis.

After the electrostatic latent image has been recorded on the photoconductive surface 12, photoconductive belt 210 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser 44, dispenses toner particles into developer housing 46 of developer unit 38.

After the electrostatic latent image is developed, the toner powder image present on photoconductive belt 210 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into registration transport 120 of the invention herein, described in detail below, past image transfer station D to receive an image from photoconductive belt or photoreceptor belt 210 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet 48 is then detacked from the photoreceptor belt 210 by corona generating device 59 which sprays oppositely charged ions onto the back side of sheet 48 to assist in removing the sheet from the photoreceptor belt 210. After transfer, sheet 48 continues to move in the direction of arrow 60 by way of belt transport 62 which advances sheet 48 to fusing station F.

Fusing station F includes a fuser assembly 70 which permanently affixes the transferred toner powder image to the sheet 48. Preferably, fuser assembly 70 includes a heated fuser roller 72 and a pressure roller 74 with the powder image on the sheet 48 contacting fuser roller 72. The pressure roller 74 is cammed against the fuser roller 72 to provide the necessary pressure to fix the toner powder image to the sheet 48. The fuser roller 72 is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roller 72.

The sheet 48 then passes through fuser assembly 70 where the image is permanently fixed or fused to the sheet 48. After passing through fuser assembly 70, a gate 80 either allows the sheet 48 to move directly via output 84 to a finisher or stacker, or deflects the sheet 48 into a duplex path 100, specifically, first into single sheet inverter 82 here. That is, if the sheet 48 is either a simplex sheet, or a completed duplex sheet having both side one and side two images formed thereon, the sheet 48 will be conveyed via gate 80 directly to output 84. However, if the sheet 48 s being duplexed and is then only printed with a side one image, the gate 80 will be positioned to deflect that sheet 48 into the inverter 82 and into the duplex path 100, where that sheet 48 will be inverted and then fed to acceleration nip 102 and belt transports 110, for recirculation back through transfer station D and fuser assembly 70 for receiving and permanently fixing the side two image to the backside of that duplex sheet, before it exits via output 84.

After the sheet 48 is separated from photoconductive surface 12 of photoreceptor belt 210, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller 29 is preferably a programmable microprocessor which controls all of the machine functions hereinbefore described. The controller 29 provides a comparison count of the copy sheets, the number of documents being recirculated, the number of copy sheets selected by the operator, time delays, jam corrections, and the like. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
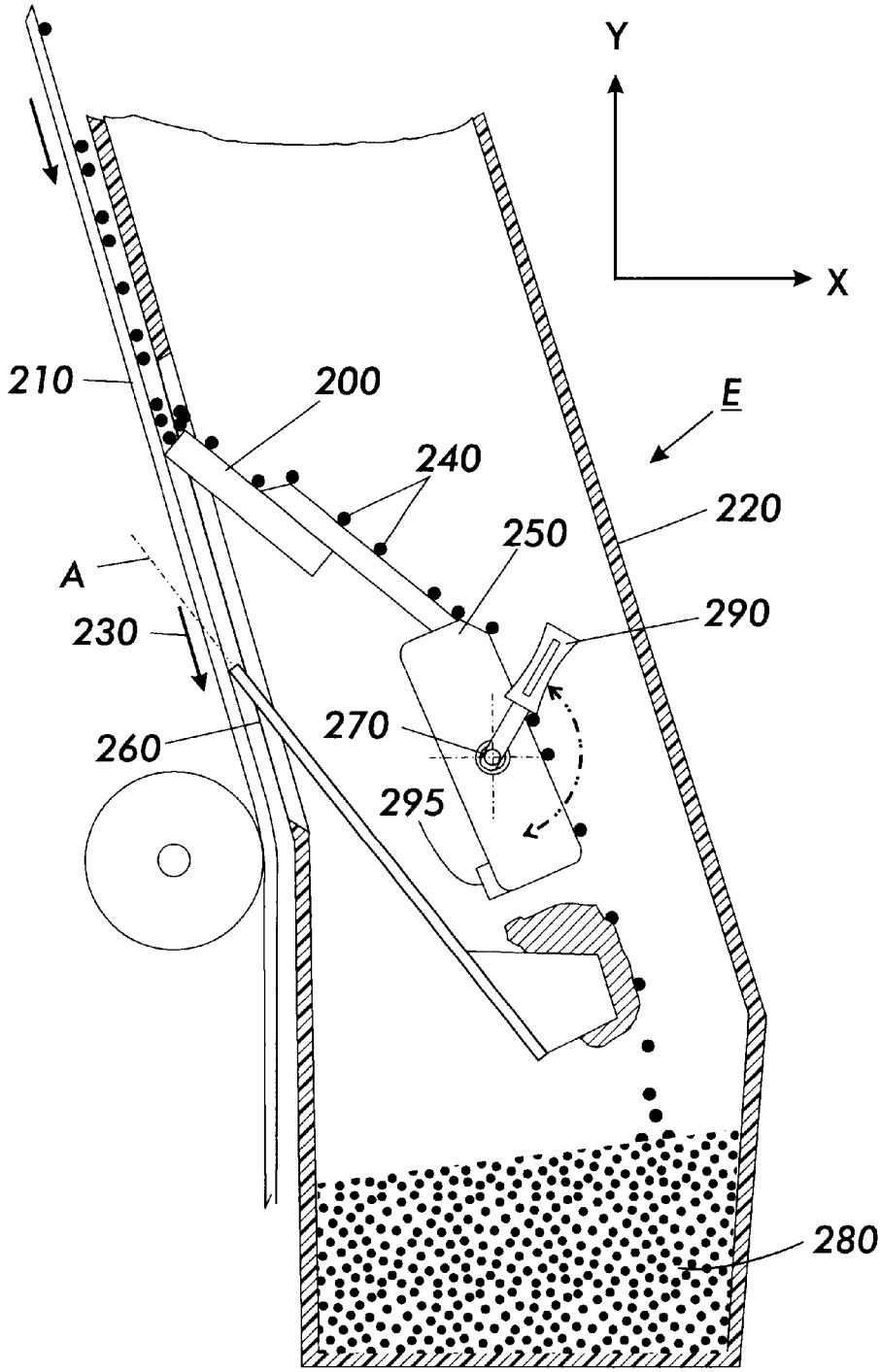
FIG. 2 shows accumulation of toner at a cleaning edge of a cleaning blade in an operative position and a seal in contact with a photoreceptor.

Reference is now made to FIG. 2, which shows a partial elevational view of a cleaning station E. The cleaning station E includes a cleaning blade 200 that contact the photoreceptor belt 210. This cleaning station E is partially enclosed in a housing 220. A brush (not shown) may be located upstream from the cleaning blade 200 and upstream from the direction of motion shown by arrow 230, of the photoreceptor belt 210. The brush may be used to mechanically clean and loosen toner 240 from the imaging surface of the photoreceptor belt 210. The cleaning blade 200 removes the toner 240 and other debris particles loosened and/or left behind by the brush from the photoreceptor belt 210. The cleaning blade 200 is attached to a cleaning blade holder 250. As the brush and cleaning blade 200 clean the imaging surface, toner 240 removed from the imaging surface accumulates at the cleaning edge of the blade 200. The cleaning blade 200 may be mounted to a the blade holder 250, which is mounted pivotally about a pivot point 270.

A seal 260 may be mounted in the cleaning station E below the cleaning blade 200. The seal 260 is movable and flexible and may contact or be slightly spaced from the photoreceptor belt 210. The seal 260 can be made from materials such as: polycarbonate, polyurethane, polyethylene, polypropylene, polyester thermoplastics (e.g. Mylar) or any other material with low resistance to set. The seal 260 is stiff enough to prevent toner 240 from escaping past the seal 260, when the seal 260 is in contact with the photoreceptor belt 210.

Figure 3:
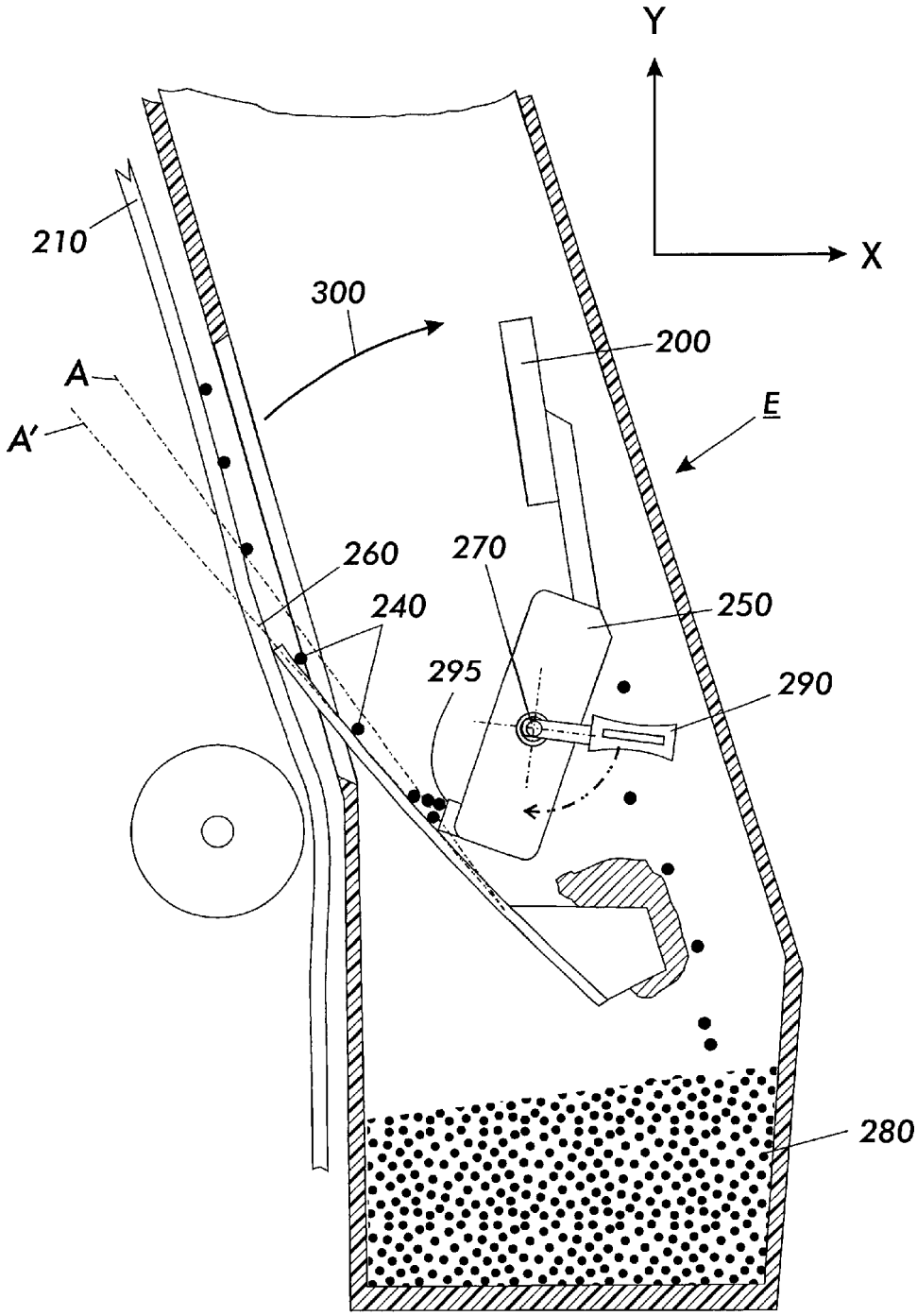
FIG. 3 shows retraction of a cleaning edge of the cleaning blade away from a photoreceptor and the drop seal actuator in contact with a seal.
Figure 4:
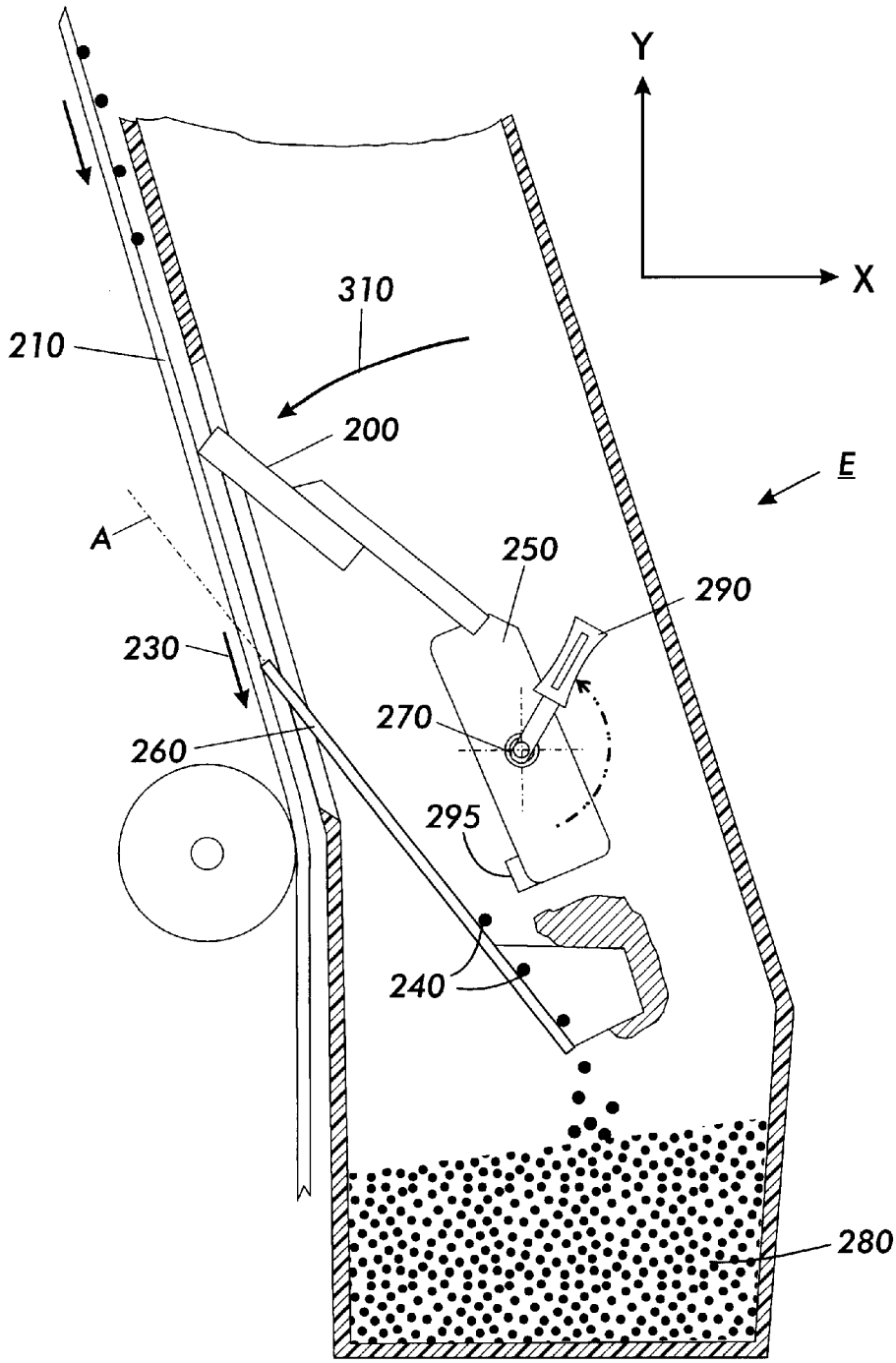
FIG. 4 shows the return of a cleaning blade to an operative position and into contact with a photoreceptor and accumulation of toner falling into the container.

Reference is now made to FIG. 3, which shows a partial elevational view of a cleaning station E. In operation, a technical service representative may pull out a drawer (not shown) from the machine after the machine has been shut off. When the drawer is open, a handle 290 or a similar mechanism for rotation is exposed that allows the technical service representative to rotate the cleaning blade 200 away from the photoreceptor belt 210, cause the photoreceptor 210 to assume a relaxed state, and to urge the end of the seal 260 further in the X direction to approach or contact the relaxed photoreceptor belt 210 as a drop seal actuator 295 urges and applies pressure to the seal 260. The seal 260 may move an angle θ which, depending on embodiment geometry, may range up to 25 degrees. The photoreceptor belt 210 illustrated is in a generally relaxed state and the free end of the seal 260 may extend further in the X direction past where the photoreceptor belt 210 where located when in an operational state as shown in FIGS. 2 and 4. Applying pressure to the seal 260 on the photoreceptor belt 210 improves the capture of toner 240 during cleaning blade 200 retraction. The movement of the cleaning blade 200 away from the photoreceptor belt 210 as shown by arrow 300 causes the drop seal actuator 295 to move into contact with the seal 260. The toner 240 falls down the length of the seal 260 and is gathered and held at the intersection of the seal 260 and the drop seal actuator 295. The seal 260 directs accumulated toner 240 at the cleaning blade 200 away from the xerographic area and into a waste container 280.

The purpose of the drop actuator seal 295 is to reduce or eliminate a toner contamination problem in the xerographic area. The increased pressure to the seal 260 upon retraction of the cleaning blade 200 and use of the drop seal actuator 295 in the cleaning system helps to prevent the contamination of the xerographic area and components, allowing for a cleaner copier or printer and help to improve copy quality, operating efficiency, reliability and life of various xerographic components such as charge devices, erase lamps and sensors. If the seal 260 has an attack angle too great, includes material that is too stiff, or has an edge that is too rough, then undue photoreceptor abrasion can occur. Premature photoreceptor abrasion greatly lessens photoreceptor life thus lowering CRU life. If the seal 260 does not extend far enough or it is installed unevenly, then toner 240 can easily pass over it and land onto a scorotron below. Any scorotron contamination reduces print quality and lowers the CRU life.

The drop seal actuator 295 simultaneously moves into position as the cleaning blade 200 moves out of its run position. Also, the photoreceptor belt 210 is relaxed as the cleaning blade 200 moves out of its cleaning position. The seal 260 has a position A during operation. Upon retraction of the cleaning blade 200 during the process of CRU removal, the drop seal actuator 295 contacts the seal 260, and urges the seal 260 out of position A in the direction toward the relaxed photoreceptor belt 210, and moves the seal 260 an angle θ from position A to a position A'. The end of the seal 260 in its position A' extends further in the X direction to a region where the photoreceptor belt 210 may have been positioned in its operational position. The end of the seal 260 is then positioned to catch loose toner 240 falling from the cleaning blade 200 and photoreceptor belt 210. Toner 240 and other debris is then directed along the seal 260 and eventually into the waste container 280. The angle θ depends on the geometry of the cleaning unit and positioning of the relaxed photoreceptor belt 210. The seal 260 in position A' may be arcuate or include a straight portion depending on the position of the photoreceptor belt 210, how far the seal 260 extends in the X direction, whether the end of the seal 260 contacts the photoreceptor belt 210, and geometry. In embodiments, angle θ may range up to 25 degrees.

In FIG. 4, shown is a partial elevational view of a cleaning station E. The cleaning blade 200 is shown in contact with the photoreceptor belt 210 and the drop seal actuator 295 is shown moved away from the seal 260. The seal 260 is in a free state without contact or pressure from the drop seal actuator 295. Toner 240 previously directed or captured by the seal 260 and drop seal actuator 295 is gravitationally urged toward the waste container 280 as the cleaning blade 200 is returned to it's operative position A and the drop seal actuator 295 simultaneously moved out of contact and spaced away from the seal 260. The printer or copying machine is now ready for operation again.

In the embodiments, the movement of the seal 260 over an angular distance θ may range up to 25 degrees when the a first member such as a cleaning blade 200 is in an inoperative position. The angular distance θ may be increased during the process of moving the first member to an inoperative position. A third member such as a seal 260 may not be straight when a second member such as a protrusion the drop seal actuator 295 or protrusion 295 contacts the third member and applies pressure thereto. The second member may be a protrusion on an end of a cleaning blade. The second member may have a length, width, and thickness and be selectively positioned on the cleaning blade. There may be no opening between the second member and the third member when the second member contacts the third member. The third member may be substantially straight when the first member is in an operative position and the second member is out of contact from the third member. The third member may not be substantially straight when the first member is in an inoperative position and the second member is in contact with third member. The first member may be made of metal, the second member may be made of a urethane and the third member may be made of mylar. The urethane may be a foam. The second member and the first member may be made of one piece and the same material. The cleaning blade may be removable away from the photoreceptor surface. The apparatus may further include a waste container adapted to receive particles. The third member may include a flexible sheet chosen from the group of materials consisting of polyester thermoplastics, polycarbonate, polyurethane, polyethylene, and polypropylene. The particles may be captured by the seal and directed therealong into the waste container. The seal may be between 2–5 mils thick and be made of at least one of Mylar, and polyester. The seal may have a thickness of about 3 mils.

In the embodiments, the method may further include: capturing between the seal and the protrusion loose toner falling from the cleaning blade; allowing the toner to be directed along a length of the seal into the waste container; returning the cleaning blade into contact with the imaging surface; moving the protrusion out of contact with the seal and causing the seal to straighten; locating the seal with respect to the cleaning blade so that toner removed and falling past the cleaning blade is supported by the cleaning seal.

In summary, the drop seal actuator 295 is a mechanical device that provides additional protection from toner droppings falling from a cleaner system onto the charging system. The drop seal actuator 295 is useful in systems where, for example, a Xerographic CRU has a cleaner system that is directly above the charging system. In operation, while removing the CRU from the machine, the customer actuates a belt module handle 290 which moves a cleaning blade away from the photoreceptor belt 210. When the blade 200 moves from a photoreceptor belt 210, excess toner 240 may spill from the cleaning blade 200. To prevent contamination from falling onto the a charge scorotron, a seal 260 is located between the cleaning system and the charging system. During normal run, the seal 260 may lightly touch the photoreceptor. At CRU removal, photoreceptor belt 210 is relaxed and the seal 260 is urged and repositioned toward the relaxed photoreceptor belt 210 by contact of the drop seal actuator 295 with the seal 260. The seal 260 then catches and directs loose toner 240 away from the charging system and reduces contamination of the charging system.

While this invention has been described in conjunction with various embodiments, it is evident that many alternatives, modifications, and variations thereof will be apparent to those skilled in the art. Accordingly, it is intended to embrace all such alternatives, modifications, and variations and their equivalents.

What is claimed is:

1. An electrostatographic apparatus comprising:

a first member having a length, a first end, and a second end, the first end for removing particles from a photoreceptor surface, the first end adapted to move from an operative position contacting the photoreceptor surface to an inoperative position spaced from the photoreceptor surface, the second end adapted to pivot and including a second member associated therewith; and a third member spaced from the first member having a length and a free end;

wherein the second member is adapted to contact the third member as the first member is moved to said inoperative position causing the third member to move an angular distance.

2. The electrostatographic apparatus of claim 1 wherein the angular distance ranges up to 25 degrees when the first member is in said inoperative position.

3. The electrostatographic apparatus of claim 1 wherein the third member is not straight when the second member contacts the third member.

4. The electrostatographic apparatus of claim 1 wherein the second member is a protrusion on an end of a cleaning blade.

5. The electrostatographic apparatus of claim 4 wherein the second member has a length, width, and thickness and is positioned on the cleaning blade.

6. The electrostatographic apparatus of claim 4, wherein the cleaning blade is removable away from the photoreceptor surface.

7. The electrostatographic apparatus of claim 1 wherein there is no opening between the second member and the third member when the second member contacts the third member.

8. The electrostatographic apparatus of claim 1 wherein the third member is substantially straight when the first member is in said operative position and the second member is out of contact from the third member and wherein the third member is not substantially straight when the first member is in said inoperative position and the second member is in contact with third member.

9. The electrostatographic apparatus of claim 1 wherein the angular distance $\theta$ is increased during the process of moving the first member to said inoperative position.

10. The electrostatographic apparatus of claim 1 wherein the first member is made of metal, the second member is made of a urethane and the third member is made of mylar.

11. The electrostatographic apparatus of claim 10 wherein the urethane is a foam.

12. The electrostatographic apparatus of claim 1 wherein the second member and the first member are made of one piece and the same material.

13. The electrostatographic apparatus of claim 1, further comprising a waste container adapted to receive particles.

14. The electrostatographic apparatus of claim 1 wherein the third member comprises a flexible sheet chosen from the group of materials consisting of polyester thermoplastics, polycarbonate, polyurethane, polyethylene, and polypropylene.

15. A customer replaceable unit comprising:

a cleaning blade assembly having a first end and a second end, the first end for removing particles from a photoreceptor surface, the first end adapted to move from an operative position contacting the photoreceptor surface to an inoperative position spaced from the photoreceptor surface, the second end having a protrusion thereon; and a seal having a length and a free end, wherein the seal is adapted to move from a first position to a second position as the first end of the cleaning blade assembly moves away from the photoreceptor surface and the protrusion contacts the seal at a position located a distance from the free end.

16. An electrostatographic apparatus for cleaning particles from a surface, comprising:

a cleaning blade for removing particles from the surface, said cleaning blade adapted to move between an operative position contacting the surface to remove particles therefrom and an inoperative position spaced from the surface, said cleaning blade having a free blade end movable between the operative position, and the inoperative position and a pivot end for rotating about a pivot; and a seal, movable between a first position and a second position in response to a protrusion on a portion of the pivot end moving in contact with the seal to urge the seal in the direction of the surface, the seal comprises a flexible sheet chosen from the group of materials consisting of polyester thermoplastics, polycarbonate, polyurethane, polyethylene, and polypropylene.

17. The electrostatographic apparatus of claim 16, wherein the particles are captured by the seal and directed therealong into a waste container.

18. A method of preventing toner contamination comprising:

accumulating toner from a photoreceptor surface on a free end of a blade, the blade comprising a pivot end including a protrusion thereon;

rotating the free end of the blade away from a photoreceptor surface causing the protrusion on the pivot end to pivot and contact a seal urging the seal to move toward the photoreceptor surface.

19. The method of claim 18, further comprising:.

capturing between the seal and the protrusion loose toner falling from the blade; and allowing the toner to be directed along a length of the seal into a waste container.

20. A method of claim 19, further comprising:

returning a cleaning blade into contact with imaging surface; and moving the protrusion out of contact with the seal and causing the seal to straighten.

21. The method of claim 20, further comprising:

locating the seal with respect to the cleaning blade so that toner removed and falling past the cleaning blade is supported by the seal.

22. A cleaning station for cleaning toner from an endless photoreceptor member in an apparatus, comprising:

a cleaning housing;

a cleaning blade assembly supported by the cleaning housing, the cleaning blade assembly having a first end and a second end, the first end for removing particles from a photoreceptor member, the first end adapted to move from an operative position contacting a photoreceptor surface to an inoperative position spaced from the photoreceptor surface, the second end having a protrusion thereon; and a seal having a length and a free end and being sufficiently stiff so that the seal can support the toner removed from the photoreceptor member, the seal is located after the cleaning blade assembly has removed the toner from the photoreceptor member; wherein the seal is adapted to be movable between a first position and a second position as the first end of the cleaning blade assembly moves away from the photoreceptor surface and the protrusion contacts the seal at a position located a distance from the free end.

23. The cleaning station of claim 22, wherein the seal is between 2–5 mils thick and made of at least one of Mylar, and polyester.

24. The cleaning station of claim 22, wherein the seal has a thickness of about 3 mils.

* * * * *